US005464185A

United States Patent [19]

Hensley

[11] Patent Number: 5,464,185

[45] Date of Patent: Nov. 7, 1995

[54] CORNER BRACKET FOR MOUNTING PLANAR OBJECT

[76] Inventor: Marcus A. Hensley, 4102 36th. SW., Seattle, Wash. 98126

[21] Appl. No.: 209,008

[22] Filed: Mar. 10, 1994

Related U.S. Application Data

[63] Continuation-in-part of Ser. No. 975,626, Nov. 12, 1992, abandoned.

[51] Int. Cl.[6] ..... A47F 7/14

[52] U.S. Cl. ..... 248/475.1; 40/152.1; 40/159.1; 248/217.3

[58] Field of Search ..... 248/475.1, 220.1, 248/216.1, 216.4, 217.3, 223.4, 224.4, 488, 220.2; 40/159.1, 156, 152.1

[56] References Cited

U.S. PATENT DOCUMENTS

| | | | |
|---|---|---|---|
| 670,853 | 3/1901 | Deckelmann | 40/156 X |
| 1,194,217 | 8/1916 | Murray | 40/159.1 X |
| 1,407,177 | 2/1922 | Stone | 40/159.1 |
| 1,633,859 | 6/1927 | Harvey | 40/159.1 |
| 1,742,615 | 3/1930 | Riley | 40/159.1 |
| 2,185,084 | 12/1939 | Hutaff, Jr. | 248/488 |
| 3,346,979 | 10/1967 | Milos | 40/159.1 |
| 3,787,934 | 1/1974 | Gross | 248/316.1 X |
| 4,103,446 | 8/1978 | Maglott | 40/152.1 X |
| 4,179,089 | 12/1979 | Parr, Jr. | 248/216.1 |
| 4,413,706 | 11/1983 | Michael | 182/91 |
| 4,886,228 | 12/1989 | Kennedy | 248/74.1 |
| 5,199,681 | 4/1993 | Reidy | 248/488 |

FOREIGN PATENT DOCUMENTS 0693498 11/1930 France .

*Primary Examiner*—Ramon O. Ramirez
*Attorney, Agent, or Firm*—Joan H. Pauly

[57] ABSTRACT

A corner bracket comprises a corner piece and an integrally attached pin. In one embodiment, the corner piece is a single, integrally-formed molded plastic piece having front and rear walls joined by sidewalls. The pin may be made from metal and be molded into the juncture between the sidewalls. The molded-in end of the pin extends inwardly nearly to the front face of the corner piece. The pin may also be molded plastic integrally molded with the corner piece. In either case, the pin projects from the rear face and terminates in a pointed end for attachment to a vertical surface. The corner piece defines a slot dimensioned to receive a corner portion of an object to be mounted, such as a mat frame. In another embodiment, the front and rear walls of the corner piece are attached to each other by a hinge. The walls and the hinge are preferably integrally molded from plastic. Edge portions of the front and rear walls are provided with snap-together interlocking portions. When the walls are moved together into a closed position, the interlocking portions hold them together and they grip a corner portion of an object, such as a poster.

20 Claims, 3 Drawing Sheets

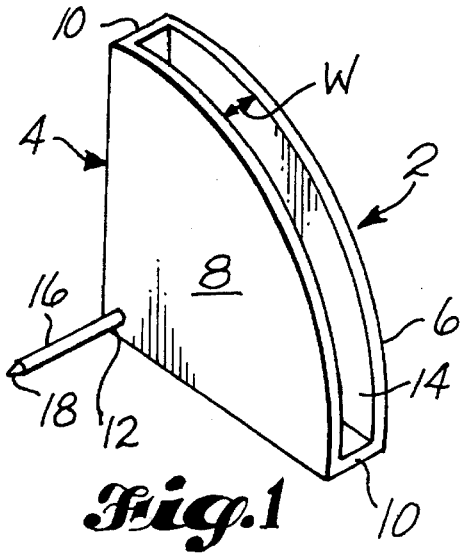
Fig.1
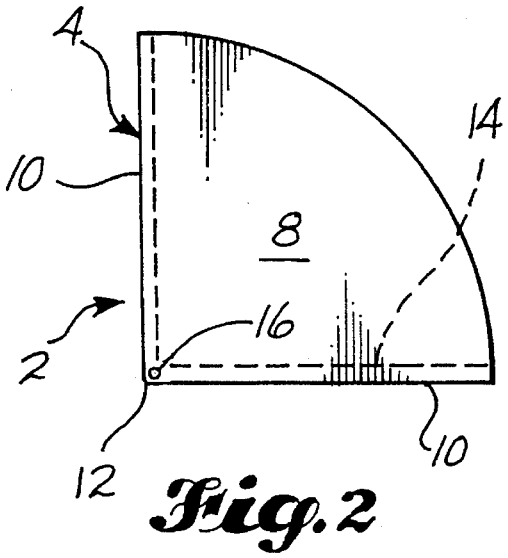
Fig.2
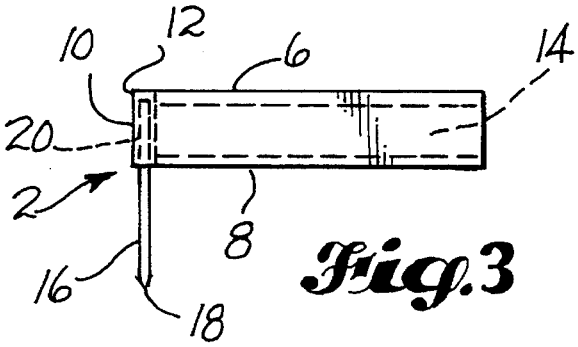
Fig.3
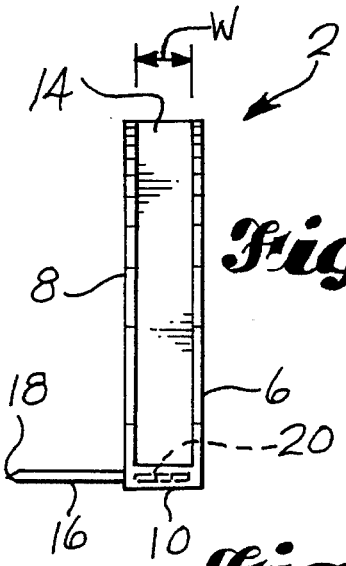
Fig.4A
Fig.4B
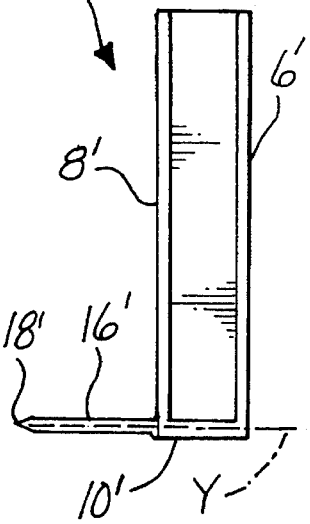
Fig.5
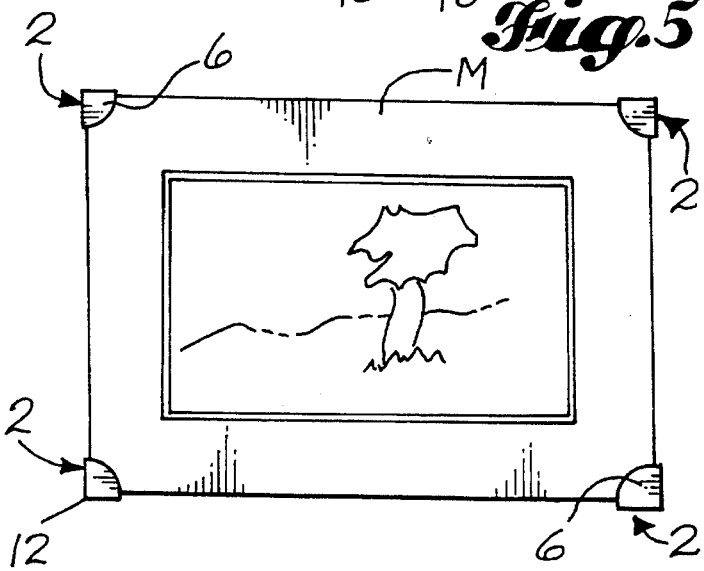

CORNER BRACKET FOR MOUNTING PLANAR OBJECT

This application is a continuation-in-part of application Ser. No. 07/975,626, filed Nov. 12, 1992, now abandoned.

TECHNICAL FIELD

This invention relates to corner brackets for mounting planar objects, such as mat frames and posters, and more particularly, to such a bracket comprising a molded plastic corner piece defining a slot for receiving a corner portion of an object, and a pin aligned with an angular edge portion of the corner piece to provide a stable secure connection between the pin and the corner piece.

BACKGROUND INFORMATION

In offices, homes, and other places, pictures in mat frames, posters, and like objects are commonly mounted on bulletin boards or walls by means of push pins. There are a number of problems associated with this common mounting method. The push pins project outwardly from the board or wall and the object and, thus, are subject to being struck by people or by other objects. When a push pin is struck, it can become loosened or dislodged, thereby decreasing the security of the mount or even allowing the mounted object to fall from the board or wall. In addition, a blow to a pin can cause motion relative to the mounted object, which may tear or otherwise damage the object. Another problem associated with the use of push pins is that they are a very informal mount for an attractive object and are generally unattractive in themselves. Moreover, even if the push pins are never struck by a person or object, they cause damage to the mounted object because they necessarily result in pin holes in the object. Use of flat-headed thumb tacks instead of push pins avoids the problem of vulnerability to being struck, but it presents the additional problem of difficult removal as well as the other problems discussed above. When any type of a separate pin or tack is used, the portion of the pin or tack shank that actually engages the .board or wall is decreased by the thickness of the object being mounted. For relatively thick objects, such as mat frames, this seriously detracts from the security of the attachment to the board or wall.

DISCLOSURE OF THE INVENTION

The subject of the present invention is a corner bracket for mounting planar objects on a vertical surface. According to a basic aspect of the invention, the bracket comprises a molded plastic corner piece and a pin integrally joined to the corner piece. The corner piece has a front wall, a rear wall, and two sidewalls extending between the front and rear walls and meeting each other at a juncture. The juncture forms an angle corresponding to an angular corner portion of the object to be mounted. The corner piece defines a slot for receiving this angular corner portion of the object. The pin includes a straight shank with a pointed end and an opposite end integrally joined to the rear wall of the corner piece adjacent to the sidewall juncture. The pin shank extends along an axis substantially perpendicularly from the rear wall to permit the corner piece to be secured to a vertical surface by exerting pressure on the front wall to pierce the surface with the pointed end of the pin. The axis extends along the pin shank and along and through the corner piece sidewalls at the sidewall juncture to provide a strong and stable connection between the pin and the corner piece.

The pin may be formed from various materials. In one embodiment, the pin is made of molded plastic, and the pin and the corner piece are integrally molded together. In another embodiment, the pin is made of metal, and the opposite end of the pin is molded into the rear wall of the corner piece to integrally join the pin to the corner piece. The sidewalls stabilize the integral connection between the corner piece and the molded-in end of the pin. Preferably, the molded-in end of the pin extends into the corner piece sidewalls at the juncture to enhance the stability of the connection between the pin and the corner piece.

In a first embodiment of the corner bracket, the sidewalls are integrally joined to each other along the juncture, and each of the sidewalls is integrally joined to the front wall and the rear wall. The slot has a predetermined width to closely receive a corner portion of an object having a thickness substantially equal to the slot width. This embodiment has the advantage of maximizing simplicity of construction and, at the same time, providing the stable integral connection between the corner piece and the pin described above. It is contemplated that this embodiment will be particularly useful for mounting mat frames. The angle at which the two sidewalls join each other may be varied. However, in most situations, the angle would be substantially equal to 90°.

In another embodiment of the bracket, one of the sidewalls includes a hinge, and the other sidewall is split into first and second separable portions integrally formed with the front wall and the rear wall, respectively. This permits the front wall and the rear wall to be pivoted away from each other about an axis defined by the hinge and then pivoted toward each other to grip therebetween the corner portion of the object to be mounted. The separable portions of the sidewall have snap-together interlocking portions to secure them to each other and secure the front and rear walls in a gripping position in which they grip the corner portion of the object being mounted. Because of this gripping action, the hinged embodiment of the bracket is particularly useful for mounting very thin objects, such as posters.

The hinge may take various forms, but it is preferably integrally molded with the front and rear walls and formed by a flexible strip of plastic. The interlocking portions may also take various forms. In their currently preferred form, they comprise a tongue and a mating groove integrally molded into the split sidewall. The tongue and groove are preferably formed on a lip projecting from one of said separable portions and an edge surface of the other separable portion. This arrangement helps avoid pinching of, and consequent damage to, the corner of a poster or other object gripped by the bracket. In addition, the lip helps to position the object in the bracket.

A preferred feature of the hinged embodiment is the provision of a combination of a recess and a projection to enhance the stability of the connection between the pin and the corner piece. The first separable portion of the split sidewall has a recess formed therein at the sidewall juncture. The second separable portion has a complementary projection formed thereon that is received into the recess when the front and rear walls of the corner piece are in their gripping position. The pin axis preferably extends through the projection. When a metal pin is used, the molded-in end of the pin preferably extends into the projection to enhance the stability of the connection.

According to another basic aspect of the invention, the bracket comprises a corner piece and a pin. The corner piece has a front wall, a rear wall, a hinge connecting adjacent edges of the walls, and snap-together interlocking portions. The walls are pivotable relative to each other about an axis defined by the hinge. They pivot between an open position and a gripping position, to grip a corner portion of an object to be mounted. The interlocking portions secure the walls together in the gripping position. The pin has a straight shank with a pointed end and an opposite end integrally secured to the rear wall. The shank extends substantially perpendicularly from the rear wall to permit the corner piece to be secured to a vertical surface, when the walls are in the gripping position, by exerting pressure on the front wall to pierce the surface with the pointed end of the pin. The interlocking portions may be provided in various forms. They preferably comprise a tongue and groove, as described above.

In order to minimize the cost of manufacture, the entire corner bracket may be made from molded plastic. Alternatively, the corner piece may be made from molded plastic, with the pin being metal for strength. In embodiments made from these materials, a recess and projection arrangement is preferably included to provide a secure stable connection between the pin and the corner piece. The front wall has an edge with a recess formed thereon, and the rear wall has a complementary projection formed thereon. The projection is received into the recess when the front and rear walls are in the gripping position. The opposite end of the pin is molded into the corner piece and extends into the projection.

The present invention solves the problems discussed above in connection with the use of push pins and thumb tacks. The bracket of the invention does not project outwardly from the mounted object like a push pin. Therefore, it has little, if any, vulnerability to becoming dislodged by passing objects or persons. The bracket of the invention can be used without causing any damage to the object being mounted, such as pin holes or tearing. In addition, the bracket holds the object more securely than push pins or thumb tacks and is more attractive in appearance. The full length of the projecting shank engages the wall or other mounting surface to provide a secure invisible attachment thereto. The bracket is also inexpensive to manufacture, easy to use, and sufficiently durable to be reused repeatedly. The provision of an integral pin prevents the pin from becoming separated from the corner piece and possibly lost. The integral pin arrangement also contributes to the attractiveness of the bracket.

Embodiments of the bracket having a molded-in metal pin have the advantage of providing a strong and stable connection between the pin and the corner piece and enhanced strength of the pin itself. The pin is highly resistant to movement relative to the plastic material of the corner piece when the pin is pushed into or removed from a board or wall. The pin resists both being pulled out from the corner piece and poking through the plastic of the corner piece. In the embodiments in which the molded-in end of the pin extends into the sidewalls or a projection, the resistance to movement out of its molded-in position is enhanced. The stability of the connection may be maximized by extending the pin shank nearly to the front face of the corner piece without obstructing any portion of the slot that receives the object. The preferred molded-in configurations also permit the use of a headless pin to simplify manufacture of the bracket and avoid obstruction of the slot by a pin head or thickening of the bracket walls to prevent such obstruction. A further advantage of the preferred configurations is that they simplify and reduce the cost of the molding process.

These and other advantages and features will become apparent from the detailed description of the best modes for carrying out the invention that follows.

BRIEF DESCRIPTION OF THE DRAWINGS

In the drawings, like element designations refer to like parts throughout, and:

FIG. 1 is a pictorial view of a first preferred embodiment of the bracket.

FIG. 2 is an elevational view of the rear face of the bracket shown in FIG. 1.

FIG. 3 is an edge elevational view of one of the sidewalls of the bracket shown in FIGS. 1 and 2.

FIG. 4 is an elevational view looking at the slot in the bracket shown in FIGS. 1–3.

FIG. 4B is like FIG. 4A except that it shows a modified form of the bracket with an integrally molded plastic pin.

FIG. 5 is an elevational view of four of the brackets shown in FIGS. 1–4 in use to mount a mat frame.

BEST MODES FOR CARRYING OUT THE INVENTION

Figure 12:
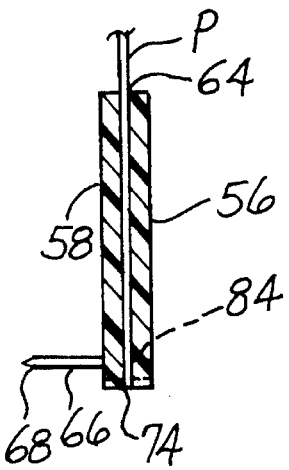
FIG. 12 is a sectional view taken along the line 12—12 in FIG. 11.
Figure 13:
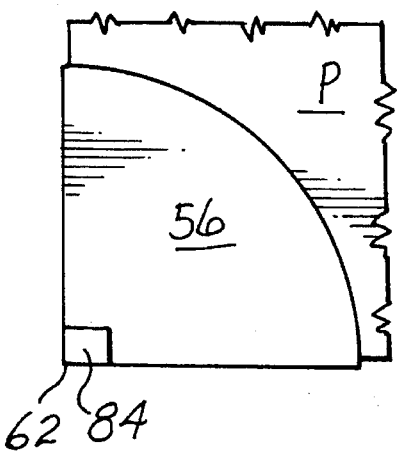
FIG. 13 is a fragmentary front elevational view of a corner section of a poster mounted by the bracket shown in FIGS. 6–12.
Figure 14:
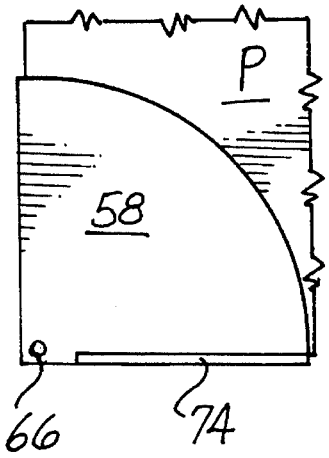
FIG. 14 is like FIG. 13 except it is a rear elevational view.

The drawings show three embodiments of a corner bracket 2, 2', 50 that are constructed in accordance with the invention and constitute the best modes for carrying out the invention currently known to the applicant. The first embodiment is shown in FIG. 5 mounting a mat frame. The second embodiment is shown in FIGS. 12–14 mounting a poster. The mat frame and poster are only two examples of objects that can be advantageously mounted by means of the bracket of the invention. It is intended to be understood that other objects may also be mounted. Some examples of other objects are artwork executed on relatively thick media, such as plywood, and unframed photographs and letters and other documents.

Referring to FIGS. 1–3, 4A, and 5, the first embodiment of the bracket 2 includes a corner piece 4 having a front wall 6 and a rear wall 8. Two sidewalls 10 extend between the front and rear walls 6, 8 and meet each other at a juncture 12. The juncture 12 forms an angle corresponding to an angular corner portion of the object to be mounted. FIGS. 1–5 illustrate what is anticipated to be the most common angular orientation of the sidewalls 10, i.e. sidewalls 10 that meet at a 90° angle. The corner piece 4 is formed from plastic which is molded into a single integral piece. The sidewalls 10 are integrally molded with the front and rear walls 6, 8 to integrally join the sidewalls 10 to each other along the juncture 12 and integrally join each of the sidewalls 10 to both the front wall 6 and the rear wall 8.

The corner piece 4 defines a slot 14 for receiving an angular corner portion of an object to be mounted, such as the mat frame M shown in FIG. 5. The slot 14 has a predetermined width W to closely receive the corner portion of the object. The dimensioning of the slot 14 is chosen so that its width W is substantially equal to the thickness of the object. The edges of the walls 6, 8 defining the open end of the slot 14 may be curved, as shown in FIGS. 1, 2, and 5.

The bracket 2 also includes a metal pin 16 that has a straight shank with a pointed end 18 and an opposite end 20. The opposite end 20 is molded into the rear wall 8 at least closely adjacent to the juncture 12 to integrally join the pin 16 to the corner piece 4. The end 20 of the pin may have, but does not need, an increased diameter portion. The shank of the pin 16 extends substantially perpendicularly from the rear wall 8 to permit the corner piece 4 to be secured to a vertical surface, such as a bulletin board or a wall, by exerting pressure on the front face of the front wall 6 to pierce the board or wall surface with the pin's pointed end 18. In the illustrated preferred embodiment, the opposite end 20 of the pin 16 extends into the corner piece sidewalls 10 at the juncture 12 to enhance the stability of the connection between the pin 16 and the corner piece 4. As illustrated in FIGS. 3 and 4A, the opposite end 20 extends nearly to the front face of the corner piece 4 to maximize the security of the connection. The end 20 of the pin 16 could also be positioned contiguous to the juncture 12, in which case it would preferably extend from the rear face nearly to the front face of the corner piece 4.

FIG. 5 illustrates the use of four of the brackets 2 to mount a mat frame M. Each corner of the frame M is received into the slot 14 of its respective bracket 2. The brackets 2 are preferably placed on the frame M before they are attached to the wall. Then, each corner is secured by exerting pressure on the front face of its bracket 2.

A second preferred embodiment 2', which is a modification of the embodiment shown in FIGS. 1–3, 4A, and 5, is shown in FIG. 4B. This embodiment of the bracket 2' is essentially the same as the first embodiment 2 except that the pin 16' is made of molded plastic, and the pin 16' and the corner piece portion of the bracket 2' are integrally molded together. In other words, the entire bracket 2', including the front wall 6', the rear wall 8', the sidewalls 10', and the pin 16', are a single integrally molded piece. Like the pin 16 in the embodiment shown in FIG. 4A, the plastic pin 16' has an outer pointed end 18' for piercing a wall or other structure to which the object received into the corner brackets 2' is to be mounted. Forward of its pointed rear end 18', the shank of the pin 16' is essentially cylindrical. The axis Y of the shank extends along the shank and along and through the sidewalls 10' at their juncture. In other words, the sidewalls 10' extend, in a forward/rearward direction, parallel to the pin axis Y, and the pin 16' is aligned with the sidewall juncture. This provides a strong and stable connection between the pin 16' and the corner piece portion of the bracket 2'. When a force is exerted on the corner of the front wall 6' adjacent to the juncture 12 to mount the bracket 2', the force is transmitted to the pin 16' through the sidewalls 10' at their juncture, and the sidewalls 10' assist the pin 16' in carrying the loads on the pin 16' as it penetrates the wall or other structure.

Figure 6:
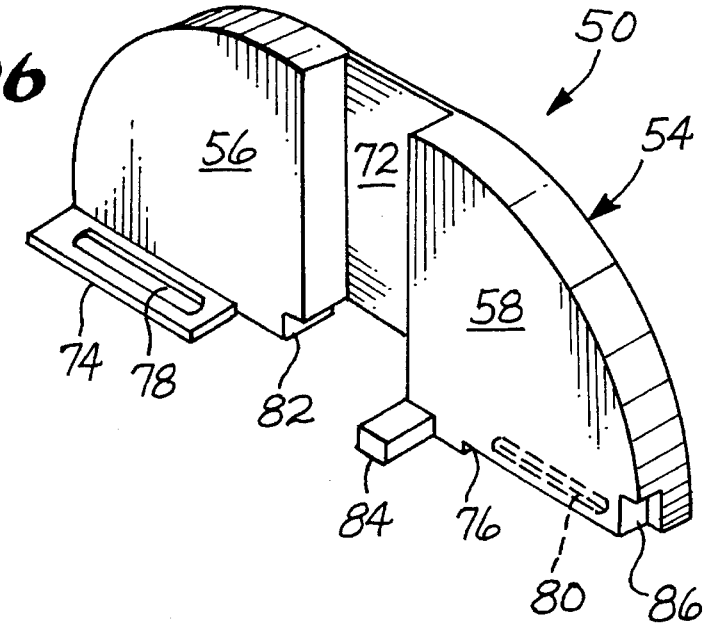
FIG. 6 is a pictorial view of a second hinged embodiment of the bracket showing the bracket in an open position.
Figure 9:
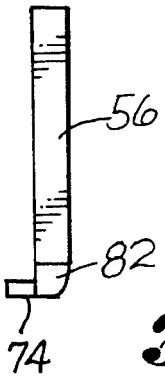
FIGS. 9 and 10 are elevational views taken along the lines 9—9 and 10—10, respectively, of FIG. 7, with the hinge omitted.
Figure 7:
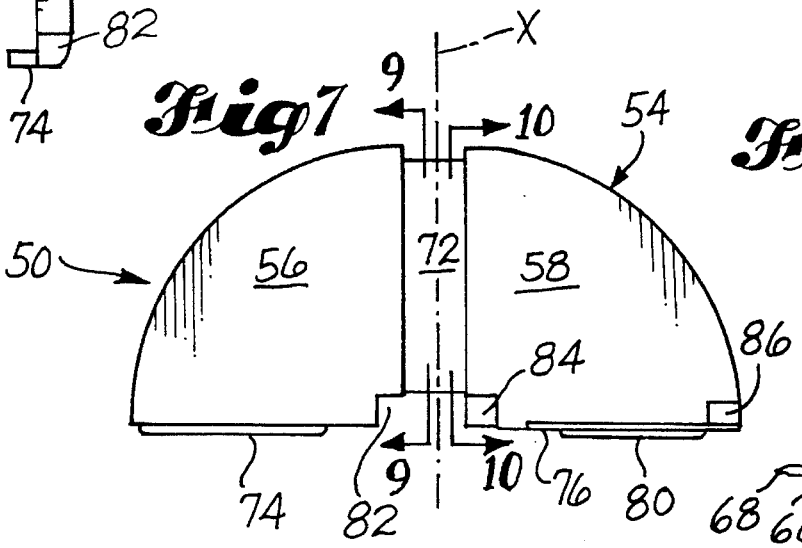
FIG. 7 is an elevational view of the bracket shown in FIG. 6 looking at the inner faces of the front and rear walls.
Figure 10:
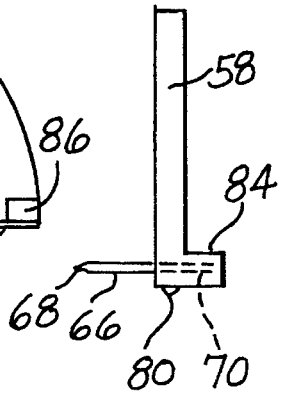
Figure 8:
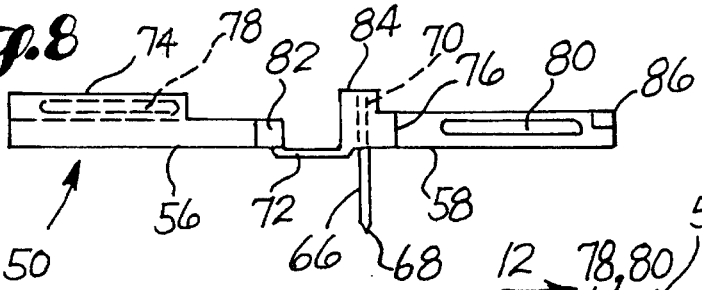
FIG. 8 is an edge view looking at the edges of the bracket shown in FIGS. 6 and 7 on which the grooved lip and tongue are formed.
Figure 11:
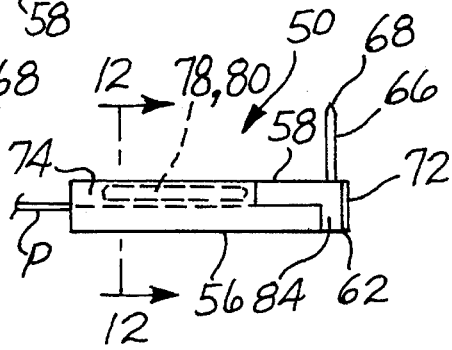
FIG. 11 is like FIG. 8 except that it shows the bracket in a closed position.

A third preferred embodiment 50 is shown in FIGS. 6–14. Like the first and second embodiments, this embodiment includes a corner piece 54 and a pin 66. Preferably, the corner piece 54 is plastic and is a single integral molded piece. The pin 66 may be molded plastic or metal. A metal pin 66 is shown in FIGS. 8 and 10. The corner piece 54 includes a front wall 56 and a rear wall 58. When the corner piece 54 is in the closed position shown in FIGS. 11–14, the front and rear walls 56, 58 are joined along two sidewalls that form an angle, 90° as shown, with each other along a juncture 62 (FIG. 11). In this embodiment, one of the sidewalls is formed by a hinge 72, and the other sidewall is formed by outer edge portions of the front and rear walls 56, 58. The hinge 72 is preferably integrally molded with the front and rear walls 56, 58 and formed by a flexible strip of plastic 72.

Still referring to FIGS. 6–14, the sidewall formed by edge portions of the front and rear walls 56, 58 is split into first and second separable portions, i.e. the edge portions of the front and rear walls 56, 58, respectively. These separable sidewall portions are integrally formed with the other portions of the front and rear walls, 56, 58. This permits the front wall 56 and rear wall 58 to be pivoted away from each other about an axis X defined by the hinge 72. The walls 56, 58 may be pivoted into an open position, such as the position illustrated in FIGS. 6–8, and then pivoted toward each other to grip between them a corner portion of an object to be mounted. The separable sidewall portions have snap-together interlocking portions to secure them to each other and secure the front and rear walls 56, 58 in a gripping position in which they grip a corner portion of an object. FIGS. 12–14 illustrate the gripping of a poster P by the corner piece 54.

The interlocking portions of the corner piece 54 may take various forms. They are preferably snap-together to enable the corner piece 54 to be easily opened and closed. The interlocking portions are also preferably integrally molded into the front and rear walls 56, 58 to simplify manufacture and help minimize its cost, and to prevent misplacement or loss of any portion of the bracket 50. As illustrated in FIGS. 6–14, the interlocking portions comprise a tongue 80 and a mating groove 78 integrally molded into the edges of the corner piece walls 56, 58. The tongue and groove could be molded onto the inner faces of the front and rear walls 56, 58 without departing from the spirit and scope of the invention. However, they are preferably provided in the type of arrangement illustrated in FIGS. 6–14. This arrangement can best be seen in FIGS. 6 and 8. A projecting lip 74 is formed on the edge of the front wall 56 and projects rearwardly therefrom. When the corner piece 54 is moved into its closed position shown in FIGS. 11–14, the lip 74 is received into an elongated shallow cutout 76 formed on the corresponding outer edge of the rear wall 58. The outer edge surface of this outer edge of the rear wall 58 has the tongue 80 formed thereon. The corresponding groove 78 is carried by the lip 74. When the front and rear walls 56, 58 are moved into their closed gripping position shown in FIGS. 11–14, the tongue 80 snaps into the groove 78.

As described above, the bracket 50 includes a pin 66. The pin 66 is integrally secured to the corner piece 54. When the pin 66 is made of metal, it preferably has a pointed end 68 and an opposite end 70 that is molded into the rear wall 58 of the corner piece 54. In order to increase the security of this molded-in connection, the rear wall 58 is preferably provided with a projection 84. The projection 84 projects forwardly from an edge of the wall 58, preferably at the juncture 62. This projection 84 permits the length of the pin's opposite end 20, which is molded into the corner piece 54, to be nearly equal to the total width of the corner piece 54 (about ⅛ inch) when the corner piece 54 is in its closed position. This maximizes the security of the molded-in connection. The edge portion of the front wall 56 has a recess 82 formed therein at the sidewall juncture 62. The recess 82 is complementary to the projection 84 and receives the projection 84 when the front and rear walls 56, 58 are in their closed gripping position. As noted above, the extension of the molded-in end 70 of the pin 66 into the projection 84 enhances the stability of the connection between the pin 66 and the corner piece 54.

Figure 15:
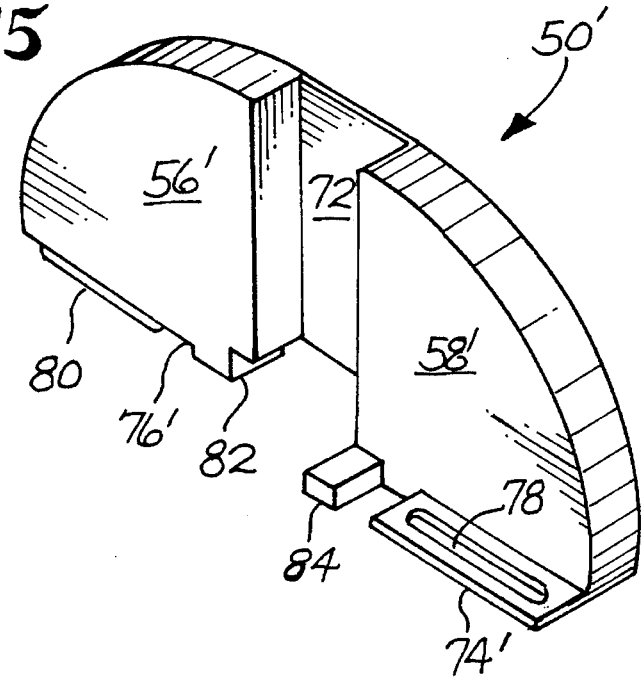
FIG. 15 is like FIG. 6 except that it shows a variation of the lip and tongue and groove arrangement.

FIG. 15 illustrates one possible variation of the recess and projection arrangement. In the modified bracket 50' shown in FIG. 15, both the projection 84' and the lip 74' are formed on the rear wall 58'. Correspondingly, both the recess 82' and the elongated shallow cutout 76' are formed on the front wall 56'. This is but one of the many possible variations of the specific arrangement of the elements of the bracket 50. With regard to this particular variation, the arrangement shown in FIGS. 6–14 is generally preferred because it results in a more continuous front face of the bracket 50. Only the outer end of the projection 84 interrupts the continuity of the front face of the corner piece 4.

The bracket 50 provides an attractive and secure mounting for very thin objects, such as posters and documents, and is very durable. At the same time, the bracket 50 is easy to use. In order to mount an item, such as the poster P shown in FIGS. 11–14, a corner portion of the poster P is positioned adjacent to the inner face of the front wall 56. The lip 74 helps to position the poster P. The edge of the poster P is placed close to the edge of the recess 82 but does not extend adjacent to the recess 82 in order to ensure that the projection 84 does not damage the poster P when the corner piece 54 is closed. Once the poster corner has been positioned, the front and rear walls 56, 58 are simply moved together and the tongue and groove 80, 78 snap together to hold the walls 56, 58 in a closed gripping position. In this position, the slot 64 formed between the front and rear walls 56, 58 for receiving the poster P is of minimal width. This enables the front and rear walls 56, 58 to grip the poster corner to securely mount the poster P, as illustrated in FIGS. 11–14.

The corner piece 54 may be secured to a bulletin board or other vertical surface either before or after it is closed to grip the corner of a poster P or other object. In the former case, the corner piece 54 would be mounted by exerting pressure on the inner face of the rear wall 58 to pierce the surface with the pointed end 68 of the pin 66. In the latter case, the pressure is exerted on the front face of the front wall 56. The bracket 50 may easily be detached from the vertical surface by pulling outwardly on it. In order to facilitate release of the gripping action on the poster corner, a coin slot 86 is preferably provided. It is positioned and dimensioned to receive a thin coin or other object. The coin need only be twisted a small amount to pop the corner piece 54 open.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. A corner bracket for mounting planar objects on a vertical surface, comprising:

a molded plastic corner piece having a front-wall, a rear wall, and two sidewalls extending between and perpendicular to said front and rear walls and meeting each other at a juncture forming an angle corresponding to an angular corner portion of the object to be mounted; said corner piece defining a slot for receiving said angular corner portion; and a pin including a straight shank having a pointed end and an opposite end integrally joined to said rear wall adjacent to said juncture, said shank extending along an axis substantially perpendicularly from said rear wall to permit said corner piece to be secured to a vertical surface by exerting pressure on said front wall to pierce said surface with said pointed end;

said axis extending along said shank of said pin and perpendicularly through said rear wall, along and through said sidewalls at said juncture from said rear wall to said front wall, and perpendicularly through said front wall, to provide a strong and stable connection between said pin and said corner piece.

2. The bracket of claim 1, in which said pin is made of molded plastic, and said pin and said corner piece are integrally molded together.

3. The bracket of claim 1, in which said pin is made of metal, and said opposite end of said pin is molded into said rear wall to integrally join said pin to said corner piece, said sidewalls stabilizing the integral connection between said corner piece and said opposite end of said pin.

4. The bracket of claim 1, in which said sidewalls are integrally joined to each other along said juncture, and each of said sidewalls is integrally joined to said front wall and said rear wall; and said slot has a predetermined width to closely receive a corner portion of an object having a thickness substantially equal to said width.

5. A corner bracket for mounting planar objects on a vertical surface, comprising:

a molded plastic corner piece having a front wall, a rear wall, and two sidewalls extending between said front and rear walls and meeting each other at a juncture forming an angle corresponding to an angular corner portion of the object to be mounted; said corner piece defining a slot for receiving said angular corner portion; and a pin including a straight shank having a pointed end and an opposite end integrally joined to said rear wall adjacent to said juncture, said shank extending along an axis substantially perpendicularly from said rear wall to permit said corner piece to be secured to a vertical surface by exerting pressure on said front wall to pierce said surface with said pointed end;

said axis extending along said shank of said pin and along and through said sidewalls at said juncture to provide a strong and stable connection between said pin and said corner piece;

in which said pin is made of metal, and said opposite end of said pin is molded into said rear wall to integrally join said pin to said corner piece, said sidewalls stabilizing the integral connection between said corner piece and said opposite end of said pin; and in which said opposite end of said pin extends into said sidewalls at said juncture to enhance the stability of the connection between said opposite end and said corner piece.

6. A corner bracket for mounting planar objects on a vertical surface, comprising: a molded plastic corner piece having a front wall, a rear wall, and two sidewalls extending between said front and rear walls and meeting each other at a juncture forming an angle corresponding to an angular corner portion of the object to be mounted; said corner piece defining a slot for receiving said angular corner portion; and a metal pin including a straight shank having a pointed end and an opposite end; said opposite end being molded into said rear wall at least closely adjacent to said juncture to integrally join said pin to said corner piece, and said shank extending substantially perpendicularly from said rear wall to permit said corner piece to be secured to a vertical surface by exerting pressure on said front wall to pierce said surface with said pointed end;

said sidewalls stabilizing the integral connection between said corner piece and said opposite end of said pin;

in which one of said sidewalls includes a hinge, and the other of said sidewalls is split into first and second separable portions integrally formed with said front wall and said rear wall, respectively, to permit said front wall and said rear wall to be pivoted away from each other about an axis defined by said hinge and then pivoted toward each other to grip therebetween said corner portion of the object to be mounted; said portions of said other sidewall having snap-together interlocking portions to secure them to each other and secure said front and rear walls in a gripping position in which they grip said corner portion.

7. The bracket of claim 6, in which said angle is substantially 90'.

8. The bracket of claim 6, in which said hinge is integrally molded with said front and rear walls and is formed by a flexible strip of plastic.

9. The bracket of claim 8, in which said interlocking portions comprise a tongue and a mating groove integrally molded into said other sidewall.

10. The bracket of claim 9, in which said first separable portion has a recess formed therein at said juncture, and said second separable portion has a complementary projection formed thereon that is received into said recess when said front and rear walls are in said gripping position; said opposite end of said pin extending into said projection to enhance the stability of the connection between said opposite end and said corner piece.

11. The bracket of claim 6, in which said first separable portion has a recess formed therein at said juncture, and said second separable portion has a complementary projection formed thereon that is received into said recess when said front and rear walls are in said gripping position; said opposite end of said pin extending into said projection to enhance the stability of the connection between said opposite end and said corner piece.

12. The bracket of claim 11, in which said hinge is integrally molded with said front and rear walls and is formed by a flexible strip of plastic.

13. The bracket of claim 6, in which said interlocking portions comprise a tongue and a mating groove integrally molded into said other sidewall.

14. The bracket of claim 13, in which one of said separable portions has a projecting lip, and said tongue and groove are formed on said lip and an edge surface of the other of said separable portions.

15. The bracket of claim 13, in which said first separable portion has a recess formed therein at said juncture, and said second separable portion has a complementary projection formed thereon that is received into said recess when said front and rear walls are in said gripping position; said opposite end of said pin extending into said projection to enhance the stability of the connection between said opposite end and said corner piece.

16. A corner bracket for mounting planar objects on a vertical surface, comprising:

a corner piece having a front wall, a rear wall, a hinge connecting adjacent edges of said walls, and snap-together interlocking portions; said walls being pivotable relative to each other about an axis defined by said hinge between an open position and a gripping position, to grip a corner portion of an object to be mounted; and said interlocking portions securing said walls together in said gripping position; and a pin having a straight shank with a pointed end and an opposite end integrally secured to said rear wall, said shank extending substantially perpendicularly from said rear wall to permit said corner piece to be secured to a vertical surface, when said walls are in said gripping position, by exerting pressure on said front wall to pierce said surface with said pointed end.

17. The bracket of claim 16, in which said corner piece is made from molded plastic, and said pin is metal; and said front wall has an edge with a recess formed therein, and said rear wall has a complementary projection formed thereon that is received into said recess when said front and rear walls are in said gripping position; said opposite end of said pin being molded into said corner piece and extending into said projection to provide a secure stable connection between said pin and said corner piece.

18. The bracket of claim 17, in which said interlocking portions comprise a tongue and a mating groove integrally molded into said front and rear walls.

19. The bracket of claim 16, in which said interlocking portions comprise a tongue and a mating groove integrally formed on said front and rear walls.

20. The bracket of claim 19, in which one of said walls has a projecting lip, and said tongue and groove are formed on said lip and an edge surface of the other of said walls.

* * * * *

UNITED STATES PATENT AND TRADEMARK OFFICE

CERTIFICATE OF CORRECTION

PATENT NO: 5,464,185

DATED: November 7, 1995

INVENTOR(S): Marcus A. Hensley

It is certified that error appears in the above-identified patent and that said Letters Patent is hereby corrected as shown below:

In column 4, line 11, "Fig. 4" should be -- Fig. 4A --.

In claim 7, column 9, line 24, "90′" should be -- 90° --.

Signed and Sealed this

Fourteenth Day of May, 1996

*Attest:*

Bruce Lehman

BRUCE LEHMAN

*Attesting Officer*

*Commissioner of Patents and Trademarks*